US006210181B1

(12) United States Patent
Tomita

(10) Patent No.: US 6,210,181 B1
(45) Date of Patent: Apr. 3, 2001

(54) PRESS-FIT TERMINAL AND ELECTRICAL CONNECTOR HAVING SAME

(75) Inventor: Mitsuhiro Tomita, Tokyo (JP)

(73) Assignee: Hirose Electric., Ltd., Tokyo (JP)

( * ) Notice: Subject to any disclaimer, the term of this patent is extended or adjusted under 35 U.S.C. 154(b) by 0 days.

(21) Appl. No.: 09/440,648

(22) Filed: Nov. 16, 1999

(30) Foreign Application Priority Data

May 27, 1999 (JP) ..... 11-147634

(51) Int. Cl.[7] ..... H01R 12/00
(52) U.S. Cl. ..... 439/82; 439/78; 439/876
(58) Field of Search ..... 439/82, 78, 876

(56) References Cited

U.S. PATENT DOCUMENTS 4,076,356 * 2/1978 Tamburro ..... 439/82
4,684,203 * 8/1987 Bihler ..... 439/82
4,735,575 * 4/1988 Shaffer ..... 439/82

FOREIGN PATENT DOCUMENTS

3120629 * 12/1982 (DE) ..... 439/82
405144490 * 6/1982 (JP) ..... 439/876
3-14782 4/1991 (JP) .
7413113 * 4/1976 (NL) ..... 439/876
7505494 * 11/1976 (NL) ..... 439/876

* cited by examiner

*Primary Examiner*—Paula Bradley
*Assistant Examiner*—Tho D. Ta
(74) *Attorney, Agent, or Firm*—Kanesaka & Takeuchi

(57) ABSTRACT

A press-fit terminal comprises a pin-like terminal body (2) having a support section (5) and a spring contact element (3). The spring contact element has a tubular body with an opening groove (3A) and is flexible in the radial direction. Also, it has an outer contact portion (6) at an utmost outer position and inner contact portions (7, 8) at an utmost inner position. The outer contact portion lies outside of the diameter of the conductive section (P1) of a through-hole but when the spring contact element is press-fitted in the conductive section and compressed, the outer and inner contact portions are brought into resilient contact with the conductive section and the support section, respectively.

3 Claims, 6 Drawing Sheets

PRESS-FIT TERMINAL AND ELECTRICAL CONNECTOR HAVING SAME

BACKGROUND OF THE INVENTION

1. Field of the Invention

The present invention relates to press-fit terminals for use in circuit boards, etc. and electrical connectors having such a terminal.

2. Description of the Related Art

Japanese UM patent application Kokoku No. 3-14782 discloses such a press-fit terminal.

As shown in FIG. 6, this press-fit terminal comprises a pin-like metallic terminal body 51 and a metallic sleeve 52 provided with a flange. The terminal body 51 has a square cross-section and has a press-fit section tapered toward the tip. The metallic sleeve 52 is put over the press-fit section.

In use, when the press-fit terminal is press-fitted into a through-hole which is provided in a circuit board P and lined with a conductive layer P1, the metallic sleeve 52 engages the circuit board P with the flange, and only the terminal body 51 is press-fitted. As the terminal body 51 is press-fitted, the tapered square press-fit section broadens the metallic sleeve 52 with the edges. Consequently, the terminal body 51 is connected electrically under the contact pressure to the conductive layer P1 of the circuit board P via the metallic sleeve 52.

However, such a conventional press-fit terminal has the following drawbacks:

(1) The metallic sleeve lacks a spring property. The metallic sleeve has a closed annular shape and lacks a spring property so that when the terminal body is press-fitted, satisfactory amounts of expansion are not provided, resulting in the low contact pressure between the metallic sleeve and the conductive layer.

(2) Amounts of expansion of the metallic sleeve tend to be different. The expansion of the metallic sleeve is made by the press-fit of the tapered press-fit section into the metallic sleeve. Consequently, if the length of press-fit (the distance traveled by the terminal body) is constant, manufacturing errors in the radial direction of respective members produce different amounts of sleeve expansion and thus different contact pressures. Consequently, when a plurality of press-fit terminals are press-fitted by the same length of press-fit, there are different contact pressures among the press-fit terminals. If an attempt is made to make the contact pressure constant, then the length of press-fit varies. In addition, since the degree of taper is small, the length of press-fit is large.

(3) A precise finish is required. If an attempt is made to keep the contact pressure within a predetermined range under a constant length of press-fit, high precision work is necessary for the inside diameter of the conductive layer, the inside and outside diameters of the metallic sleeve, and the outside diameter of the press-fit section.

(4) The press-fit terminal is prone to coming out. Since the terminal body is tapered, it tends to come out in the direction. If the degree of taper is reduced to minimize the coming out, then the length of press-fit is too large to be practical.

SUMMARY OF THE INVENTION

Accordingly, it is an object of the invention to provide a press-fit terminal able to produce a satisfactory contact pressure by a small length of press-fit and an electrical connector having such a press-fit terminal.

A press-fit terminal relative to the invention is press-fitted in the through-hole of a circuit board and brought into contact with a conductive section of the through-hole.

According to the invention the press-fit terminal comprises a pin-like terminal body and a spring contact element attached around the terminal body. The terminal body has a support section at a middle portion in the longitudinal direction for supporting the spring contact element. The spring contact element has a tubular form with at least one opening groove extending in the longitudinal direction to make the spring contact element flexible at the radial direction. It has an outer contact portion at an utmost outer position in the radial direction and inner contact portions at an utmost inner position in the radial direction. The outer contact portion normally lies outside of the diameter of the conductive section of the through-hole.

When the press-fit terminal is press-fitted in the conductive section, however, the spring contact element is compressed to bring the outer and inner contact portions into resilient contact with the conductive section and the support section, respectively.

According to one aspect of the invention, the support section has a stepped-down tubular form with shoulders at opposite ends, and the spring contact element has the maximum diameter at the central position in the axial direction as the outer contact portion and the minimum diameter at the opposite ends as the inner contact portions which engage the shoulders to control axial movement of the spring contact element so that the outer contact portion makes contact with the conductive section in a large area and the terminal is fixed in the through-hole by the spring contact element which engages the shoulders.

According to another aspect of the invention, the spring contact element has at least one of a boss at a middle portion in the axial direction and a ridge extending in the axial direction as the outer contact portion and the minimum diameter at opposite ends as the inner contact portions which engage the shoulders to control axial movement of the spring contact element. Consequently, the press-fit terminal is easy to press-fit and in contact with the conductive section of the through-hole in a large area in the longitudinal direction to prevent tilt of the terminal. The outer contact portion has a gentle slope in the press-fit direction and a steep slope in the removal direction so that it is easy to press-fit but difficult to remove.

Such press-fit terminals are mounted in a housing to provide an electrical connector. The housing has a control face which abuts on the circuit board to control the depth of press-fitting of the terminal into the through-hole so that the quantity of press-fitting is determined automatically to provide a constant contact pressure.

DESCRIPTION OF THE PREFERRED EMBODIMENTS

Figure 1:
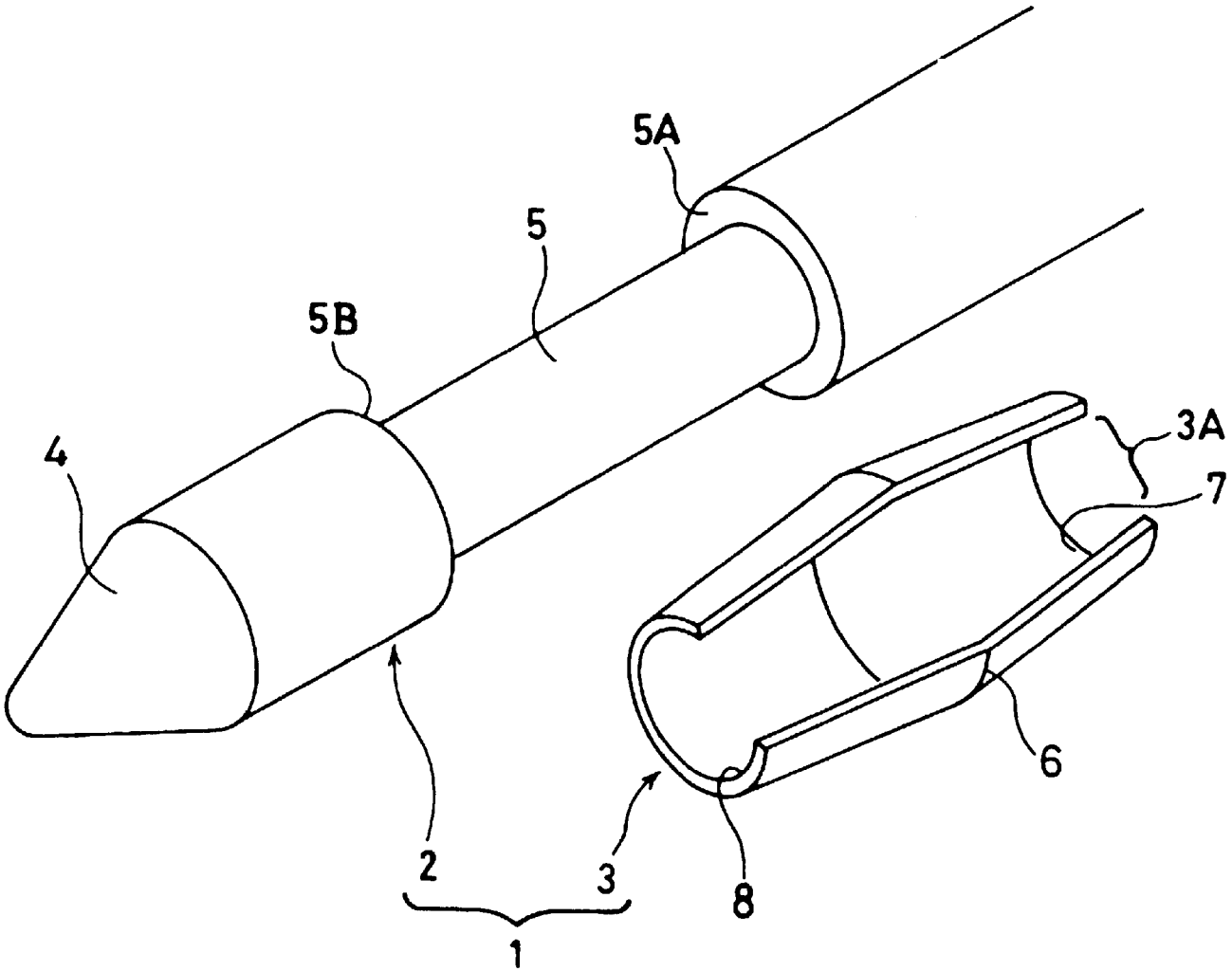
FIG. 1 is a perspective view of a press-fit terminal according to one embodiment of the invention.

In FIG. 1, a press-fit terminal 1 comprises a terminal body 2 and a spring contact element 3. The terminal body 2 has a metallic pin-like shape, a conic front end 4 for making press-fitting easy, and a support section 5 in the middle. The support section 5 has a thin cylindrical surface between shoulders 5A and 5B.

The spring contact element 3 has a substantially C-shaped cylindrical form with an opening groove 3A and a spring property in the radial direction. It is preferred that the spring contact element 3 is made from a spring material. The spring contact element 3 is attached to the support section 5 by temporarily broadening the opening groove 3A. The spring contact element 3 is tapered toward both the ends and has an outer contact section 6 at the maximum circumference and inner contact sections 7 and 8 at the minimum circumferences.

The outer contact section 6 has an outer diameter greater than the inside diameter of a conductive layer provided in a through-hole of a circuit board and is able to be compressed to the inside diameter of the conductive layer when it is press-fitted into the through-hole. The inside diameter of the inner contact sections 7 and 8 is set at such a level that the inner contact sections are pressed against the support section 5 at a time of the compression of the outer contact section.

Figure 2:
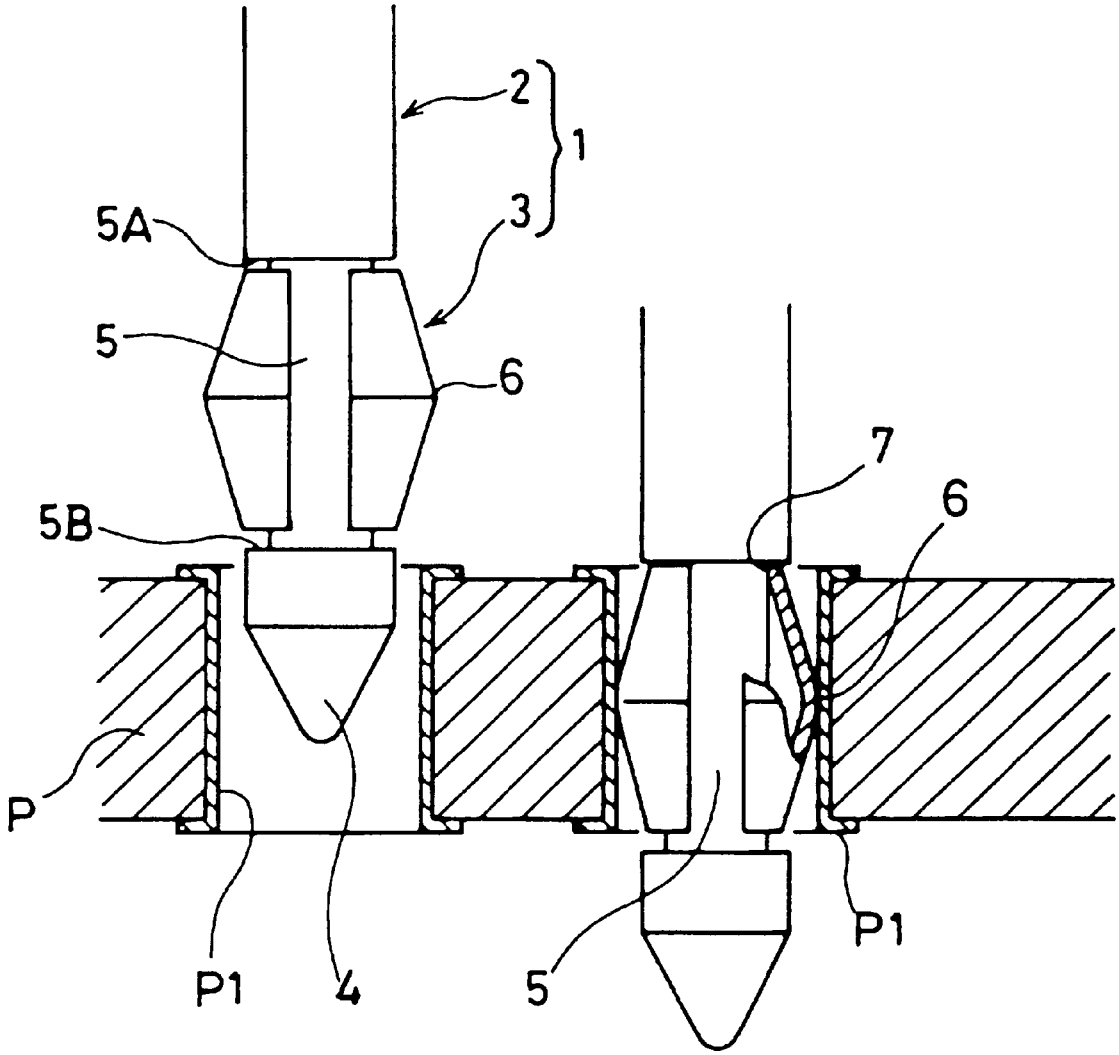
FIG. 2 is a sectional view showing how to use the press-fit terminal.

The use and function of the press-fit terminal are as follows. As shown in FIG. 2, the left-hand press-fit terminal 1, with the spring contact element 3 attached to the terminal body 2 by the support section 5, is inserted into a through-hole, which has a conductive layer P1 provided on the inside wall, to such a condition as shown by the right-hand terminal.

Since the spring contact element 3 engages the shoulder 5A of the support section 5 upon insertion, it advances on the conductive layer P1 along with the terminal body 2. When the outer contact section 6 contacts the conductive layer P1, the spring contact element 3 is compressed resiliently at the outer contact section 6. This compression bring the inner contact sections 7 and 8 into contact with the support section 5. That is, the outer and inner contact sections 6, 7, and 8 are brought into contact with the conductive layer P1 and the terminal body 2, respectively, under a predetermined resilient contact pressure.

Thus, the terminal body 2 is connected to the conductive layer P1 via the spring contact element 3, and thus a predetermined circuit trace which is connected electrically to the conductive layer P1.

As shown in FIGS. 3(A)–(E), the spring contact element 3 can take various forms.

Figures 3A, 3B, 3C, 3D, 3E:
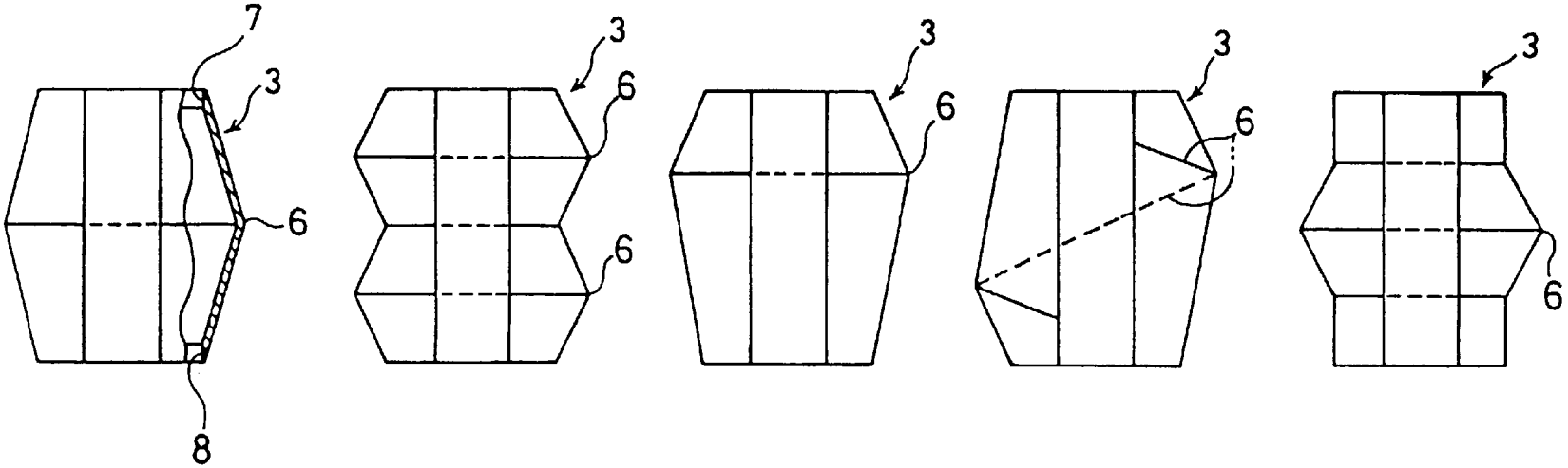
FIGS. 3(A)–(E) are front elevational views of various spring contact elements for the press-fit terminal.

In FIG. 3(A), the inside surfaces of the inner contact sections 7 and 8 are made parallel to the surface of the support section 5 of the terminal body 2. Such a structure reduces the friction between the support section 5 and the inner contact sections 7 and 8 when the spring contact element expands in the axial direction upon compression.

In FIG. 3(B), two outer contact sections 6 are provided to increase the contact area and reliability. In FIG. 3(C), the outer contact section 6 is shifted from the center owing to the condition of a circuit board. In FIG. 3(D), the outer contact section 6 is made spiral to increase the contact length and assure contact with the conductive layer which has a small error in the axial direction. In FIG. 3(E), the outer contact section 6 comprises a cylindrical section and a tapered section on which an outer contact section is provided.

Figure 4A:
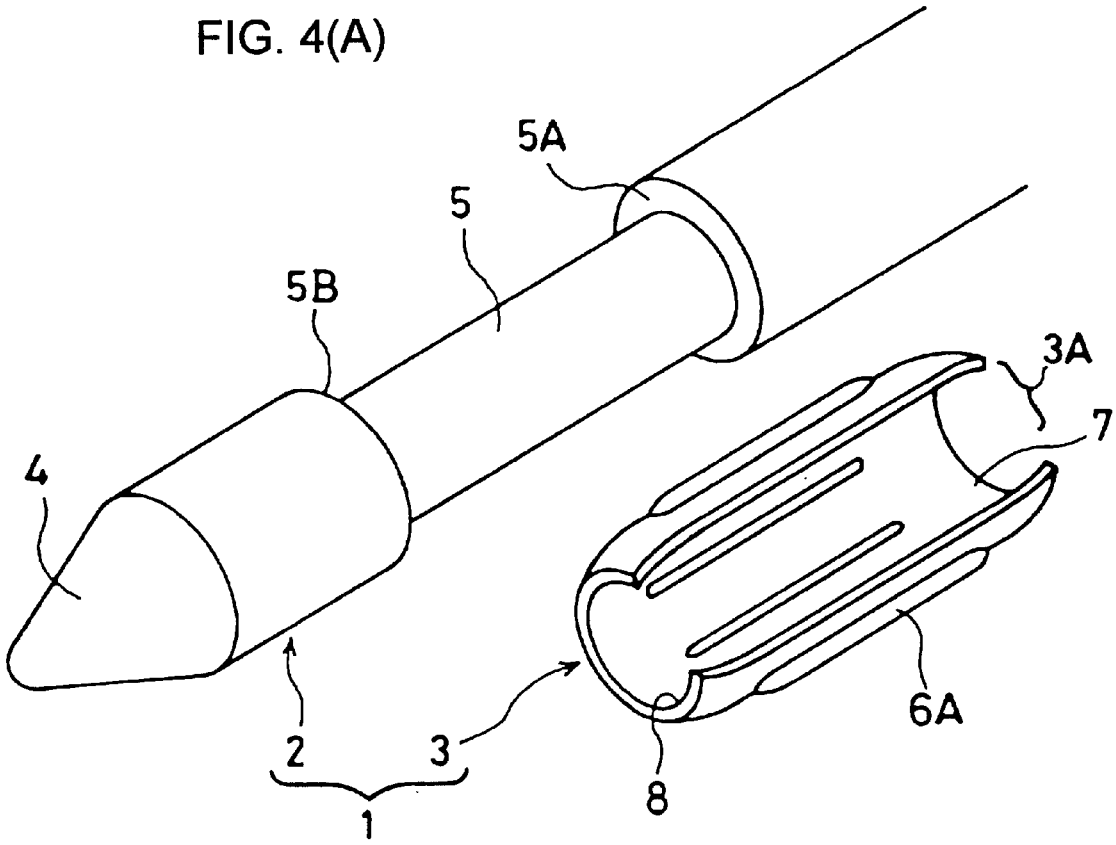
FIG. 4(A) is a perspective view of a press-fit terminal according to another embodiment of the invention.

In FIGS. 4(A) and (B), the outer contact section comprises a plurality of ridges 6A extending in the axial direction and bosses 6B, respectively.

Figure 4B:
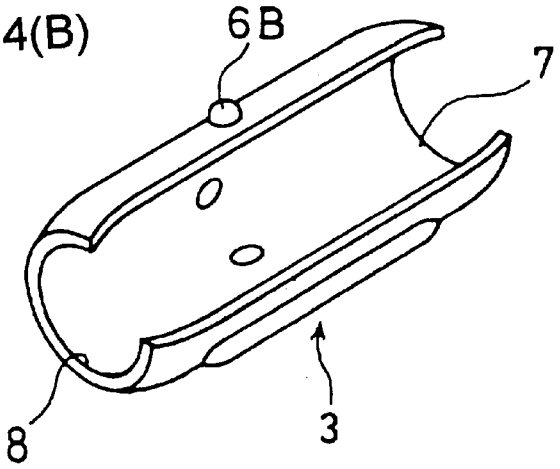
FIG. 4(B) is a perspective view of a spring contact element according to still another embodiment of the invention.
Figure 5:
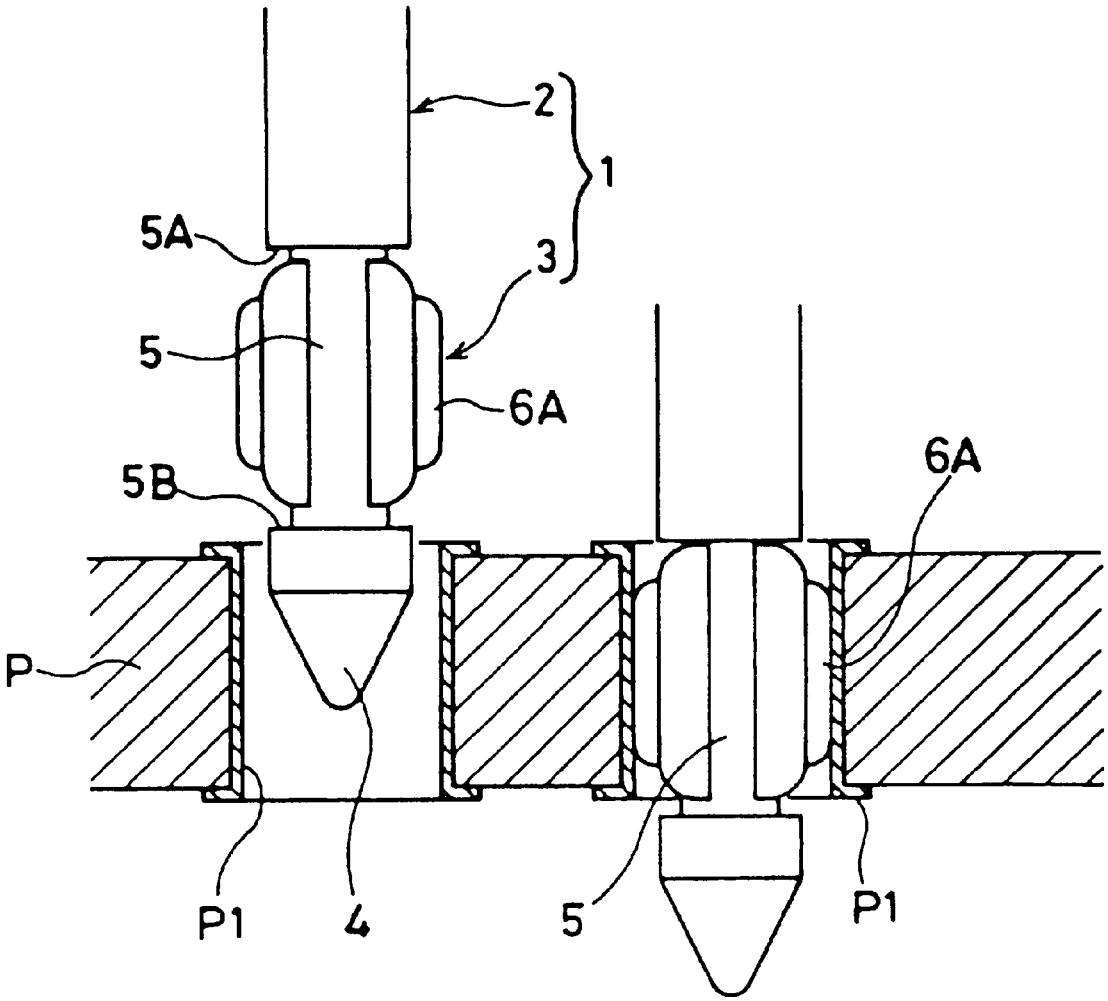
FIG. 5 is a sectional view showing how to use the press-fit terminal of FIG. 4(A)
Figure 6:
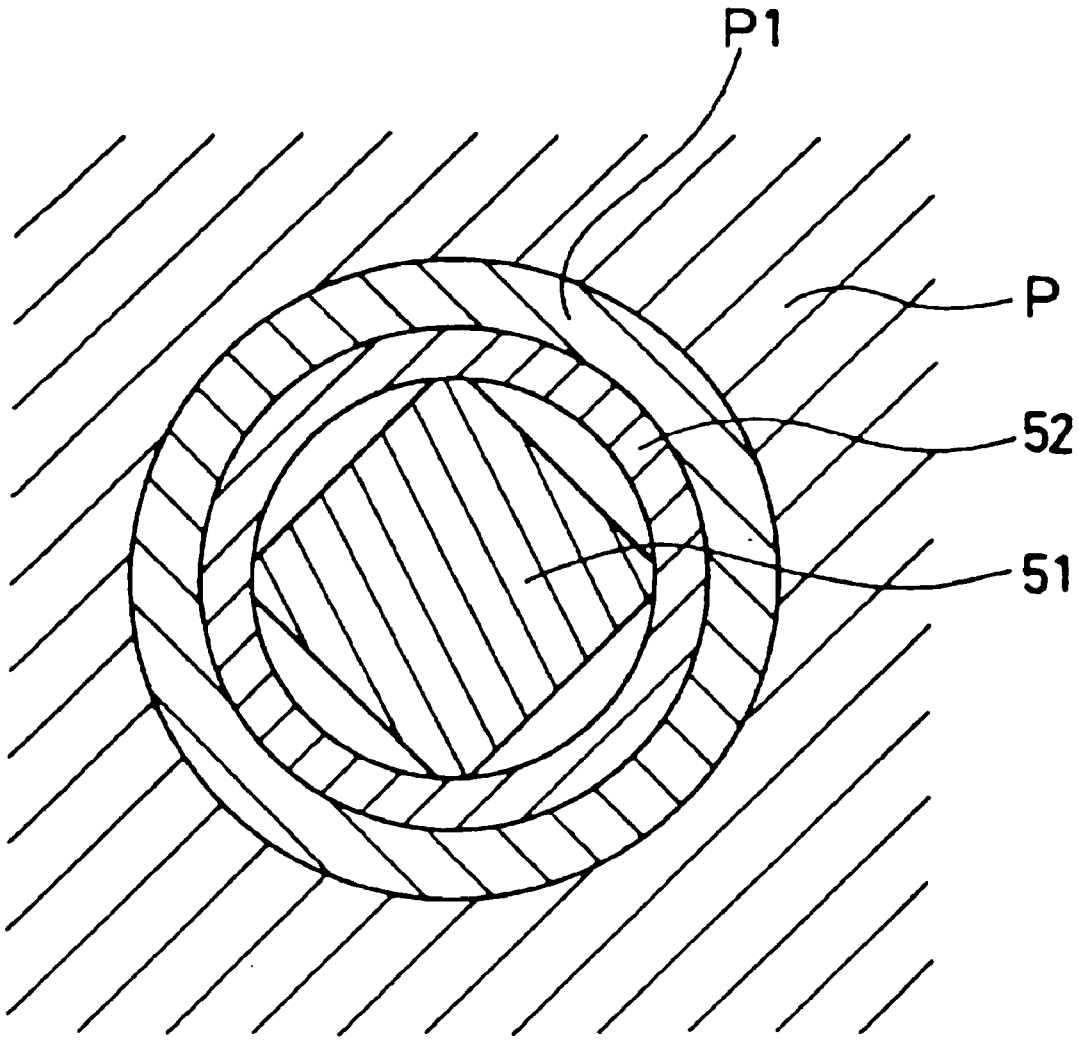
FIG. 6 PRIOR ART
FIG. 6 is a cross-sectional view of a conventional press-fit terminal.

In FIG. 4(A), the spring contact element 3 comprises a substantially cylindrical outer surface on which a plurality of ridges 6A are provided so as to extend in the axial direction, forming an outer contact section 6A. Since the ridges 6A extend in the axial direction or the press-fit direction of a press-fit terminal, it is possible to make smooth press-fitting at low resistance. Since it is brought into close contact with the through-hole in a large area in the axial direction, the attitude of the press-fit terminal is stabilized as shown in FIG. 5. Alternatively, the ridges may be bosses 6B as shown in FIG. 4(B). By providing a plurality of bosses 6B spaced in the axial direction, it is possible to prevent the tilt of a press-fit terminal as described above. Moreover, both the ridges of FIG. 4(A) and the bosses of FIG. 4(B) may be provided.

According to the sprit of the invention there are provided modifications other than the illustrated embodiments. For example, the opening groove is not necessarily extended over the entire area in the axial direction. The spring contact element may be connected in the circumferential direction. In this case, there may be provided a plurality of open grooves, with the openings alternated.

According to the invention, the press-fit terminal is provided in the housing of an electrical connector. Usually, a plurality of press-fit terminals are provided in the housing. Preferably, the housing has a regulation face for abutment to a circuit board to determine the depth of press-fit in the circuit board.

As has been described above, according to the invention, the spring terminal with an axial open groove is provided on the terminal so that satisfactory contact pressure is provided at the inner and outer contact areas even if the length of press-fit is equal to as small as the thickness of the circuit board. The degree of compression of the spring contact element is sufficiently large to absorb the dimensional errors of respective members so that high-precision work of the respective members is not necessary.

What is claimed is:

1. A press-fit terminal to be press-fitted in a through-hole of a circuit board and brought into contact with a conductive section of said through-hole, said press-fit terminal comprising:

a pin-shaped terminal body having a support section at a middle portion thereof in a longitudinal direction;

a spring contact element supported by said support section of said terminal body and having a tubular form with at least one opening groove extending in said longitudinal direction thereby making said spring contact element flexible in a radial direction;

said spring contact element having an outer contact portion provided at an utmost outer position in said radial direction or in a spiral direction and at least one inner contact portion provided at an utmost inner position in said radial direction such that said outer contact portion normally lies outside of a diameter of said conductive section of said through-hole but when said spring contact element is press-fitted in said through-hole and compressed, said outer contact portion is brought into contact with said conductive section in said radial or spiral direction and said inner contact portion is brought into contact with said support sections.

2. A press-fit terminal according to claim 1, wherein said support section has a stepped-down tubular form with shoulders at opposite ends, and said spring contact element has said outer contact section at a central position in said longitudinal direction and said inner contact portion at least one of opposite ends thereof, engaging one of said shoulders to thereby control axial movement of said spring contact element.

3. An electrical connector comprising:

a housing; and a press-fit terminal according to claim 1 or 2.

* * * * *